US005165226A

United States Patent [19]

Newton et al.

[11] Patent Number: 5,165,226

[45] Date of Patent: Nov. 24, 1992

[54] SINGLE VORTEX COMBUSTOR ARRANGEMENT

[75] Inventors: Peter Newton, Mississauga; Alex Prociw, Elmira; Frank Shum, Mississauga, all of Canada

[73] Assignee: Pratt & Whitney Canada, Inc., Longueuil, Quebec, Canada

[21] Appl. No.: 743,533

[22] Filed: Aug. 9, 1991

[51] Int. Cl.[5] ..... F02C 3/14

[52] U.S. Cl. ..... 60/39.36; 60/750; 60/756

[58] Field of Search ..... 60/738, 750, 752, 755, 60/756, 757, 758, 39.36

[56] References Cited

U.S. PATENT DOCUMENTS

| | | | |
|---|---|---|---|
| 2,581,999 | 1/1952 | Blatz | 60/756 |
| 2,974,485 | 3/1961 | Schiefer | 60/756 |
| 3,869,864 | 3/1975 | Bunn | 60/757 |
| 4,051,670 | 10/1977 | Pierce | 60/755 |
| 4,244,179 | 1/1981 | Kainov et al. | 60/39.36 |

*Primary Examiner*—Louis J. Casaregola
*Attorney, Agent, or Firm*—Troxell K. Snyder

[57] ABSTRACT

An annular combustor liner (30) includes louvers (52, 54, 56, 70, 72) for inducing the formation of a single toroidal vortex (68) adjacent a domed upstream portion (34) of the liner (30).

2 Claims, 1 Drawing Sheet

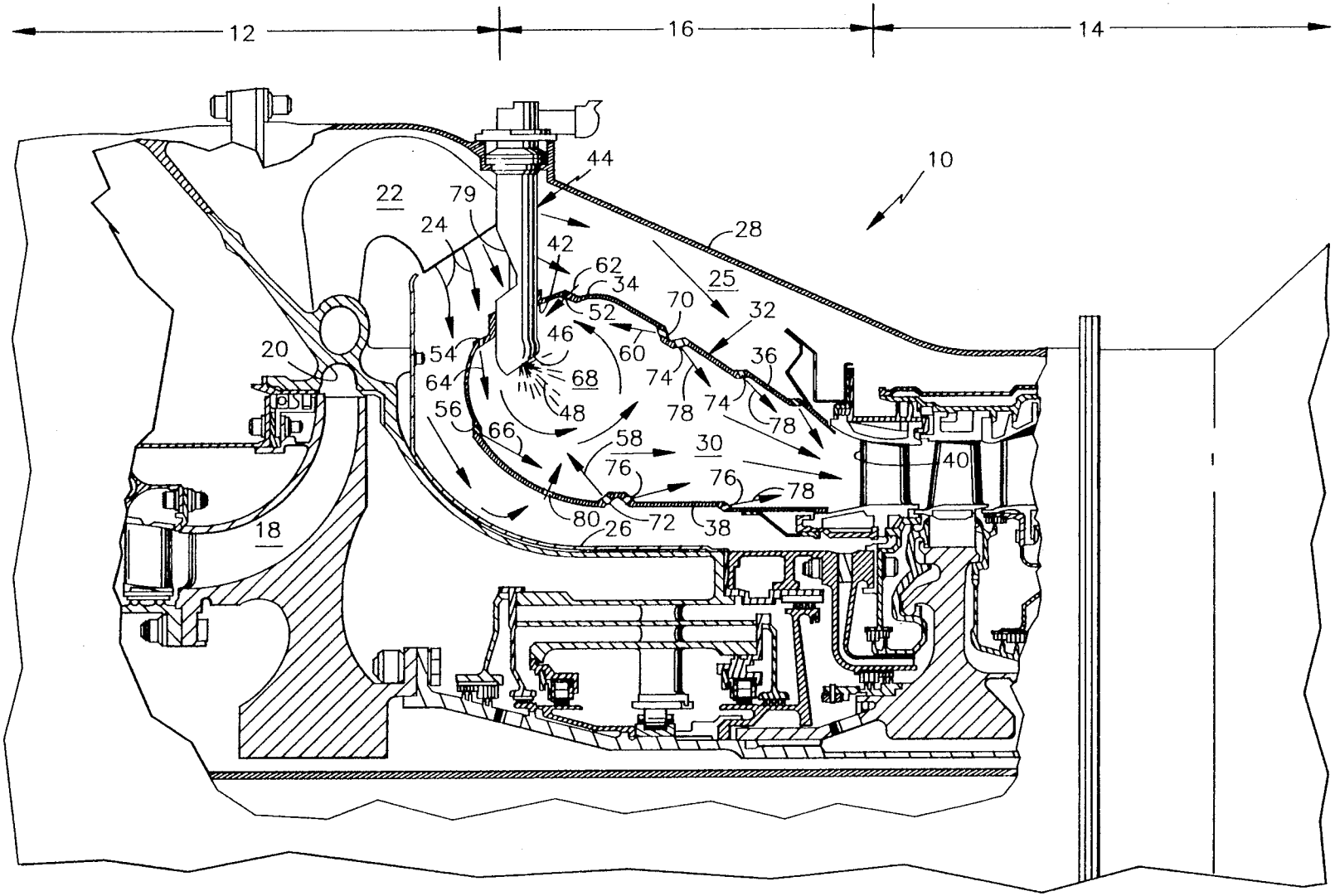
10
12
14
16
18
20
22
24
25
26
28
30
32
34
36
38
40
42
44
46
48
52
54
56
58
60
62
64
66
68
70
72
74
76
78
79
80

SINGLE VORTEX COMBUSTOR ARRANGEMENT

FIELD OF THE INVENTION

The present invention relates to a combustor for a gas turbine engine.

BACKGROUND

It is the function of the combustor section of a gas turbine engine to completely react the engine fuel and compressed air delivered from the upstream combustor section prior to discharging the heated combustion products into the downstream turbine section. Typical combustors contain the engine working fluid in an annular region defined by inner and outer engine case walls, while the fuel and air are mixed and reacted within one or more combustion chambers located within the annular region.

A typical combustion chamber is defined by an air cooled liner which includes a plurality of openings for admitting pressurized air delivered by the upstream engine compressor section, and at least one fuel nozzle for delivering a flow of combustion fuel. The gas dynamics within the combustion chamber is extremely complex, as the designer attempts to maximize mixing, flame stability, turndown ratio combustion efficiency, and pressure loss within a limited space. Mixing and flame stability are, in larger engines, achieved by directing a substantial fraction of the compressed air into the combustion chamber through louvers or openings located about the periphery of the larger opening through which the fuel nozzle penetrates the combustor liner. This nozzle air flow is usually swirled or otherwise vectored so as to create an immediate zone of recirculation in the vicinity of the discharged fuel stream within the combustor. The recirculating air and combustion products stabilize the reacting fuel air mixture within the combustor, preventing flameout or other instabilities. The rapidly swirling or recirculating air mixture also enhances dispersion and reaction of the fuel within the chamber, assisting in causing the fuel and air to complete the combustion reaction prior to exiting the chamber.

The use of an individual air swirler for each fuel nozzle is common, if not necessary, in combustor arrangements wherein a plurality of individual combustion chambers are located within the annular combustor zone, with each chamber having a single corresponding fuel nozzle. The use of individual swirlers is also quite common in larger gas turbines wherein a single annular combustor arrangement is used, but has proved less desirable for small gas turbine engines wherein space considerations make it difficult to incorporate an individual air swirler for each nozzle. Another factor to be considered in the design of a combustor for a gas turbine engine is the ability of such combustor to accommodate varying flows of fuel and air while maintaining stable performance.

SUMMARY OF THE INVENTION

It is an object of the present invention to provide a combustor-fuel injector arrangement which maintains a single, toroidal recirculation zone during full power operation for enhancing flame stability. It is still further an object of the present invention to provide a combustor-fuel injector arrangement which operates satisfactorily at reduced or start-up air flow rates.

According to the present invention, a combustor section of a gas turbine engine receives a flow of compressed air from a diffuser outlet, or the like. The combustor section includes a combustor liner defining an annular combustion chamber, the liner shaped to define an upstream, domed portion which is disposed directly in the incoming compressed air flow steam, and two downstream walls bounding an annular flow path for directing the flow of combustion products into the annular inlet of the downstream turbine section.

At least one airblast-type fuel nozzle extends through the domed portion at a point coincident with the stagnation point of the compressed air stream flowing over the exterior of this liner. The nozzle discharges combustible fuel into the interior of the combustion chamber.

The liner further includes a plurality of louver openings located in the liner walls and domed portion for admitting compressed air into the combustion chamber from the exterior side of the liner. The louvers are oriented so as to discharge the air into the combustion chamber adjacent the interior surface of the liner in a direction which is locally parallel to such interior surface. By arranging the louvers of one of the walls and the domed portion to discharge cooling air in the same direction substantially, the liner arrangement of the present invention causes the creation of a single, toroidal recirculation zone, or vortex, within the combustion chamber and adjacent the interior side of the domed portion. The nozzle is adapted to discharge a dispersed stream of liquid fuel into the central portion of the single recirculation zone, thus insuring good mixing and a stabilized flame front.

An airblast fuel nozzle requires a certain amount of airflow through the nozzle to function properly. By locating the nozzle opening in the domed portion coincident with the external air flow stagnation point, the liner arrangement according to the present invention enhances the proportion of air entering adjacent to and into the nozzle during periods of reduced or relatively low air flow thereby improving nozzle and combustor performance during such periods. The enhancement of the local air flow delivery within the chamber maintains a recirculating zone adjacent the fuel nozzle, thereby enhancing low load stability of the combustor.

Both these and other objects and advantages of the combustor arrangement according to the present invention will be apparent to those skilled in the art following a review of the following detailed description and the appended claims and drawing figures.

BRIEF DESCRIPTION OF THE DRAWING

The sole FIGURE shows a partial cross section of the combustor section of a gas turbine engine having a combustor arrangement according to the present invention.

DETAILED DESCRIPTION

Referring to the drawing figure, a half plane cross section of a gas turbine engine 10 is shown. The engine comprises a forward compressor section 12, an aftward turbine section 14, and an intermediate combustor section 16. Air flow entering the engine passes through one or more compressor stages, exiting the last stage 18 at the compressor outlet 20 which, in the embodiment shown in the FIGURE is connected to a plurality of diffuser pipes 22 for reducing the velocity and increasing the static pressure of the compressor outlet air.

The air flow 24 exiting the diffuser flows into an annular zone 25 in the combustor section 16 which is defined by a pair of radially spaced inner and outer engine cases 26, 28.

Disposed within the annular combustion zone 25 is an annular combustion chamber 30 defined by a liner 32. The liner 32 further includes an upstream portion 34 having a domed-shaped cross section, and two downstream, radially spaced walls 36, 38 which extend between the dome-shaped portion 34 and the annular inlet 40 of the turbine section 14.

The liner 32 includes a plurality of openings disposed therein, including an upstream nozzle opening 42 located in the domed-shaped portion 34 at a point which would correspond to the external fluid flow stagnation point for the diffuser outlet flow 24 which impacts the upstream dome portion 34. An airblast fuel nozzle 44 penetrates the liner 32 through the nozzle opening 42 and includes a nozzle tip 46 for discharging a flow 48 of dispersed fuel and air into the chamber 30.

Liner 32 is cooled by a plurality of louver openings 52, 54, 56, 70, 72, 74, 76 which admit compressed air from the combustor zone 25 into the interior of the chamber 30. The louvers are arranged so as to discharge the air substantially parallel to the interior surface of the liner 32 and in specific directions as discussed below.

According to the present invention, louvers 52, 54, and 56, are oriented so as to discharge the corresponding air jets 62, 64, and 66 in substantially the same general direction with regard to the interior of the dome 34. Dome air jets 62–66 thus induce the formation of a single, recirculating toroidal vortex 68 adjacent the domed portion 34 of the combustor liner 32. This recirculating vortex 68 is further supported by the air jets 58, 60 discharged from the upstream louvers 70, 72 disposed in the wall portions 36, 38.

As will be noted in the drawing, louvers 70, 72 are oriented so as to discharge the corresponding air jets 60, 58 toward the domed portion 34. Thus, air jet 60 serves to reinforce the formation of the vortex 68, while air jet 58, discharging in an opposite direction with regard to the domed air jets 62–66 acts to unseat the circulating flow from the interior surface of the liner 32 stabilizing the vortex 68 adjacent the domed portion 34. Also shown are a series of normally discharging jets 80, located between the domed jets 62–66 and the opposit ly discharging jets 58. Additional wall louvers 74, 76 discharge additional cooling air 78 for protecting the liner walls 36, 38 by virtue of film cooling as is well known in the art.

The dispersed fuel 48 discharged from the nozzle tip 46 mixes with the air in the circulating vortex 68 and is initially ignited by an electro-igniter (not shown). During operation of the gas turbine engine, reacting fuel and air circulates in the vortex 68 stabilizing the combustion process by continually mixing hot combustion products with unreacted fuel and air. The hot products serve to ignite the newly admitted fuel and air within the combustion chamber 32, thus permitting the combustor to maintain a stable reacting flame as the flow of fuel and air is varied over the engine operating envelope.

The gas turbine engine 10 having a combustor arrangement according to the present invention would utilize a plurality of fuel nozzles 44 each penetrating the annular liner 32 at circumferentially spaced locations with respect to the engine centerline (not shown). Each nozzle 44 discharges fuel into the single toroidal vortex 68, providing enhanced stability over prior art nozzle arrangements wherein each nozzle includes a surrounding turbulence generating swirler or the like. The single vortex of the combustor arrangement of the present invention offers flexibility in locating the fuel nozzles around the upstream end of the combustor to take advantage of geometric features of particular engines. This flexible fuel nozzle placement also allows for axial and tangential fuel discharge trajectories.

The location of the fuel nozzle 44 and nozzle opening 42 coincident with the stagnation point of the external air flow 24 discharged from the diffuser pipes 22 also enhances low load, low flow performance as specific quantity of air has to enter the fuel nozzle 44 through the air inlet opening 79 to atomize the fuel spray at low load condition. The stagnation point of a gas flowing over an external surface corresponds to the point of highest static pressure on the body surface. Thus, the highest static pressure over the exterior of the liner 32 is in the region of the nozzle opening 42. Thus, even at low diffuser discharge air flow rates, the airflow from louvers 52, 54, 56 disposed adjacent to the fuel nozzle 44, as well as airflow exiting the nozzle tip 46, will be at a comparatively higher flow rate than from louvers, etc., in the remainder of the combustion chamber 30. The increased local airflow maintains good nozzle performance and a strong recirculating vortex even at low load conditions.

While disclosed in terms of a gas turbine engine having a centrifugal compressor final stage, a pipe diffuser, and a louvered combustor liner 32, it will be apparent to those skilled in the art that the combustor arrangement of the present invention may be equivalently embodied with a completely axial compressor having an annular diffuser and a cooling liner utilizing shaped holes or other means for admitting and directing compressed air into the interior of combustion chamber.

We claim:

1. In an annular combustor for a gas turbine engine having an annular liner defining an internal combustor chamber, and receiving a flow of pressurized air directed onto the exterior of said liner, and a plurality of fuel nozzles extending through said liner for discharging liquid fuel into the chamber, the improvement comprising:

a first plurality of louvers disposed in a dome shaped portion of the liner, said first louvers oriented to discharge a first flow of air along side the interior of said liner in substantially a first direction, a second plurality of louvers, disposed at the upstream edge of one of two downstream extending liner walls, the second louvers oriented to admit a second flow of air along side the interior of said liner and directed toward said domed portion, a third plurality of louvers, disposed at the upstream edge of the other liner wall, the third louvers oriented to admit a third flow of air along side the interior of said liner and toward the domed portion, the third air flow being directed substantially opposite the direction of the first air flow, and wherein, each of the plurality of fuel nozzles extends through the dome shaped portion of the liner at a point coincident with the local exterior air flow stagnation point.

2. The combustor as recited in claim 1, wherein each fuel nozzle further comprised:

an air inlet opening, located exteriorly of the liner, for admitting a fourth flow of air into the nozzle, said fourth flow of air being discharged into the chamber along with the liquid fuel.

* * * * *